US005989161A

United States Patent [19]

Wang et al.

[11] Patent Number: 5,989,161

[45] Date of Patent: Nov. 23, 1999

[54] VIBRATION ABSORBING STRUCTURE FOR TREADMILL

[75] Inventors: Leao Wang, Taichung; Peter We, Taichung Hsien, both of Taiwan

[73] Assignee: Greenmaster Industrial Corp., Taiping, Taiwan

[21] Appl. No.: 09/022,378

[22] Filed: Feb. 12, 1998

[51] Int. Cl.[6] ..... A63B 22/00

[52] U.S. Cl. ..... 482/54; 482/51

[58] Field of Search ..... 482/51, 54

[56] References Cited

U.S. PATENT DOCUMENTS 4,274,625 6/1981 Gaetano ..... 482/54

5,441,468 8/1995 Deckers et al. ..... 482/54

5,599,259 2/1997 Skowronski et al. ..... 482/54

*Primary Examiner*—Glenn E. Richman

[57] ABSTRACT

An improved vibration absorbing structure of treadmill is comprising two connecting rods on both sides of the support board; a tube on each angled tube with one insertion unit on either side of the tube; an angled tube is fixed on each connecting rod and this angled rod is connected to a tube with an elastic unit and an insertion unit; the tube is connected with a cap by a fixing bolt with another elastic unit in between. Therefore, the supporting board can send its vibrations to the two tubes and the vibrations can be effectively absorbed by the two elastic units at both sides of the two tubes.

1 Claim, 3 Drawing Sheets

VIBRATION ABSORBING STRUCTURE FOR TREADMILL

BACKGROUND OF THE INVENTION (a) Field of the Invention

This invention relates generally to a vibration absorbing structure of treadmill, and more particularly, to a newly invented vibration absorbing structure of treadmill that has good vibration absorbing capability and does not generate frictional noises.

(b) Description of the Prior Art

FIG. 1 shows the most commonly used vibration absorbing structure of treadmill. This structure consists of elastic units 10 installed between a treadmill base 11 and support board or treadmill framework 12. Though, in the beginning, this structure has good vibration absorbing capability, these elastic units 10 will develop elastic fatigue and may become broken after a duration of use. Moreover, when these elastic units 10 are damaged and needed to be replaced, the treading belt 13 and support board 12 have to be removed. From above mentioned, we can see that this structure is not structurally practical and does not provide sufficient accessibility.

FIGS. 2 and 3 show another patented vibration absorbing structure according to prior art. This structure consists of a base 14 with a spring holder 15, which allows its vertical rod 16 to insert with a connecting unit 17 in between. Its spring units 18 are installed between the spring holder 15 and vertical rod 16. These units 18 are fixed down by the two bolts 19 and extend from the bottom of spring holder 15 into the bottom parts of the vertical rods 16. When its treadmill base 20 is pressed and starts to vibrate, this will in turn cause the two vertical rods 16 to vibrate too. However, these two vertical rods 16 are held down only by the connecting unit 17 and two bolts 19 plus the fact that a person's body weight exerts scores of kilograms of force on the support board 20, these two vertical rods 16 can be held down effectively by this way are a question. In addition, the vibrations of the vertical rods 16 will cause the two bolts 19 to vibrate and these vibrations will in turn generate annoying noises due to the friction between these two bolts and the bolt holes 21 of the 14; also these vibrations will damage the two rods 19 too.

SUMMARY OF THE INVENTION

The primary object of the present invention is to provide an improved vibration absorbing structure of treadmill that has good vibration absorbing capability, does not generate noises and has a structural design that its parts can be easily accessed and replaced so that the practicality and durability of a treadmill can be achieved.

DESCRIPTION OF THE PREFERRED EMBODIMENT

Figure 1:
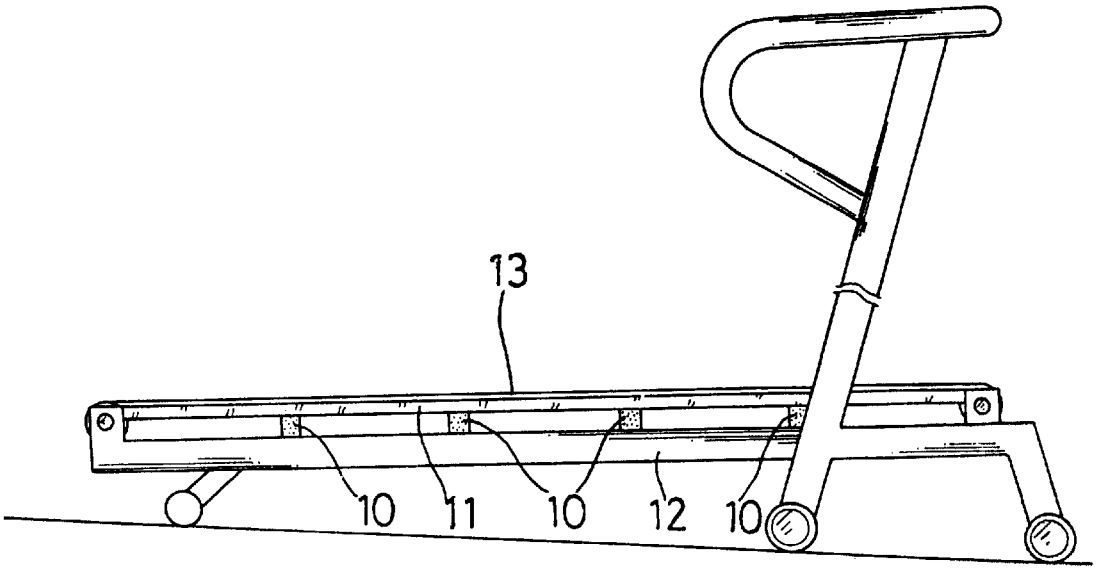
PRIOR ART. FIG.1
FIG. 1 is a schematic plan view of a vibration absorbing structure of treadmill according to prior art
Figure 5:
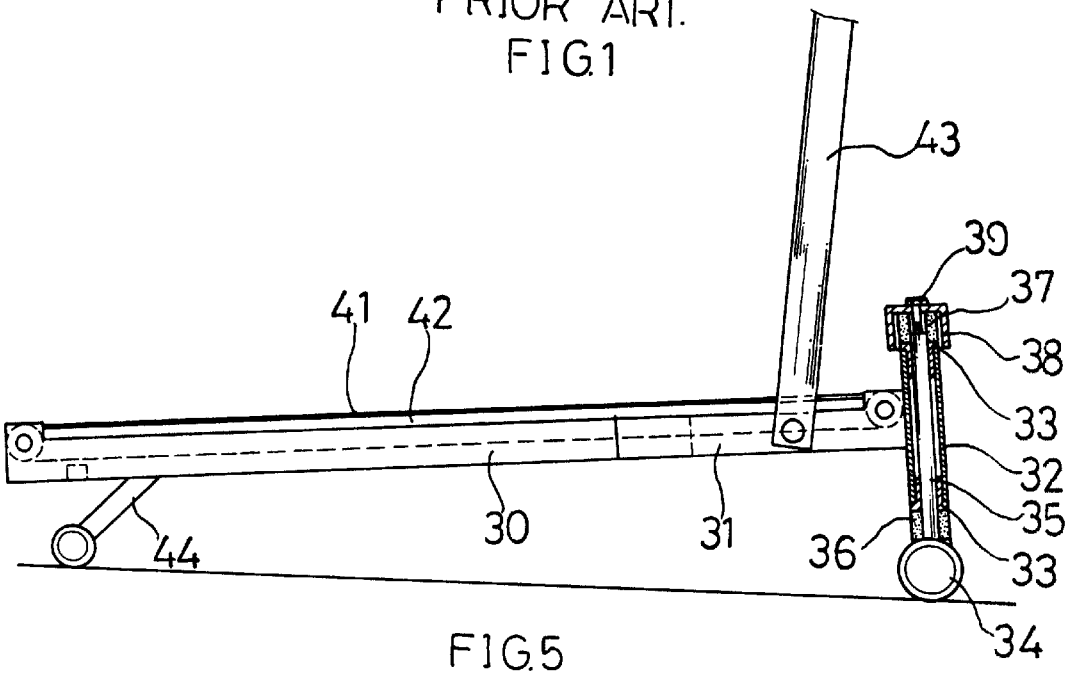
FIG. 5 is a cross-sectional side view according to the present invention.
Figure 2:
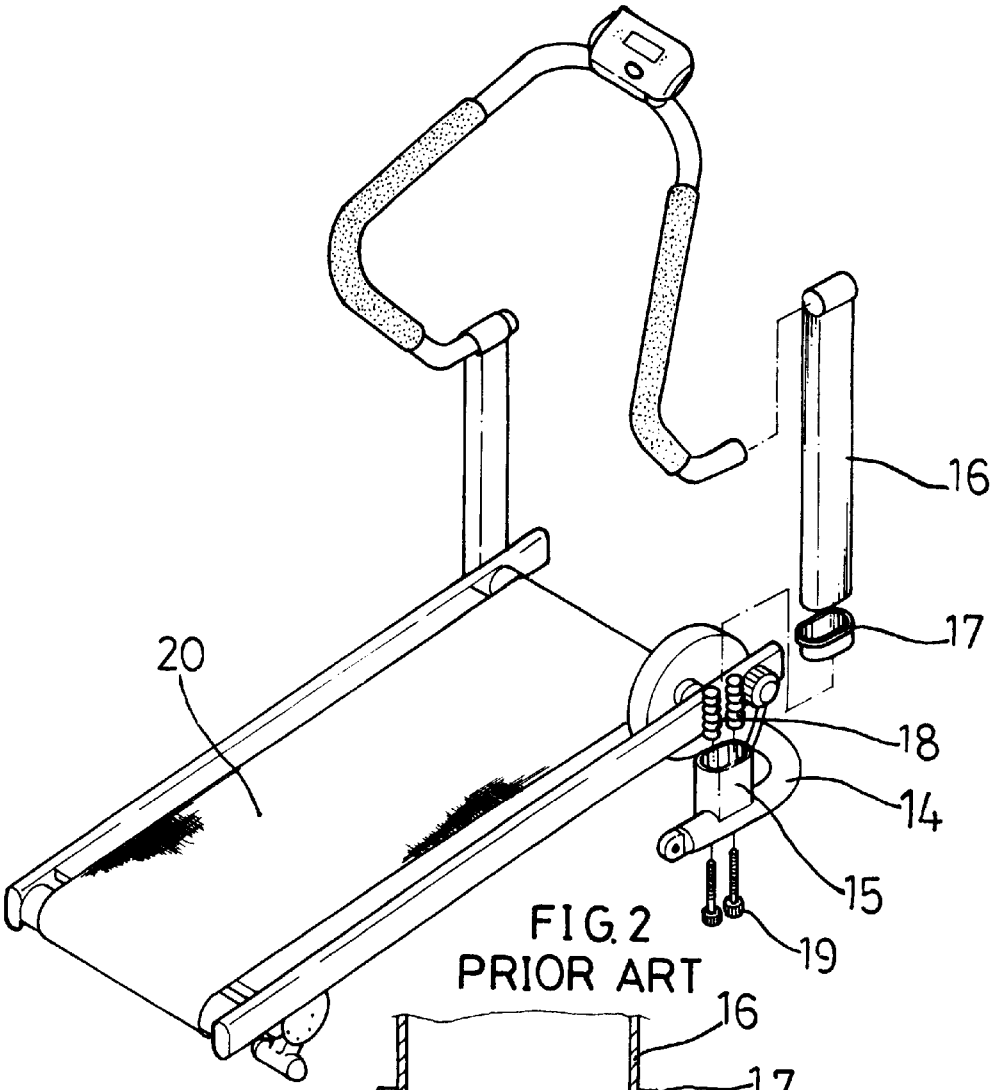
FIG. 2 PRIOR ART
FIG. 2 is an exploded view of another vibration absorbing structure of treadmill according to prior art.
Figure 3:
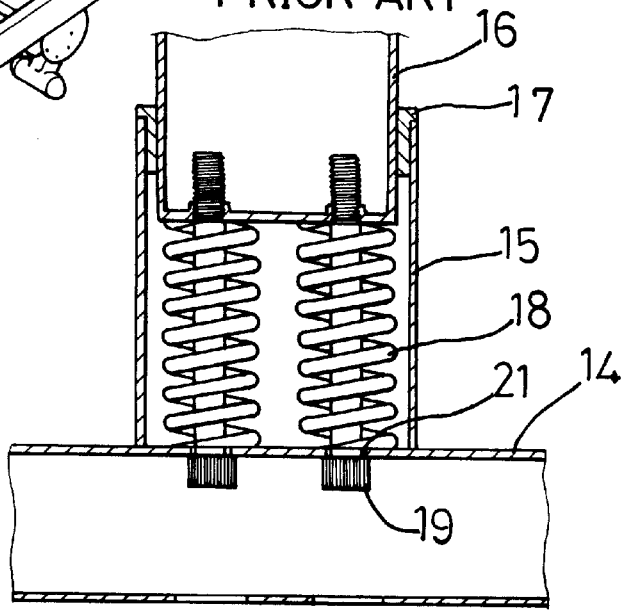
FIG. 3 PRIOR ART
FIG. 3 is a partially sectional view of the machine of FIG. 2.
Figure 4:
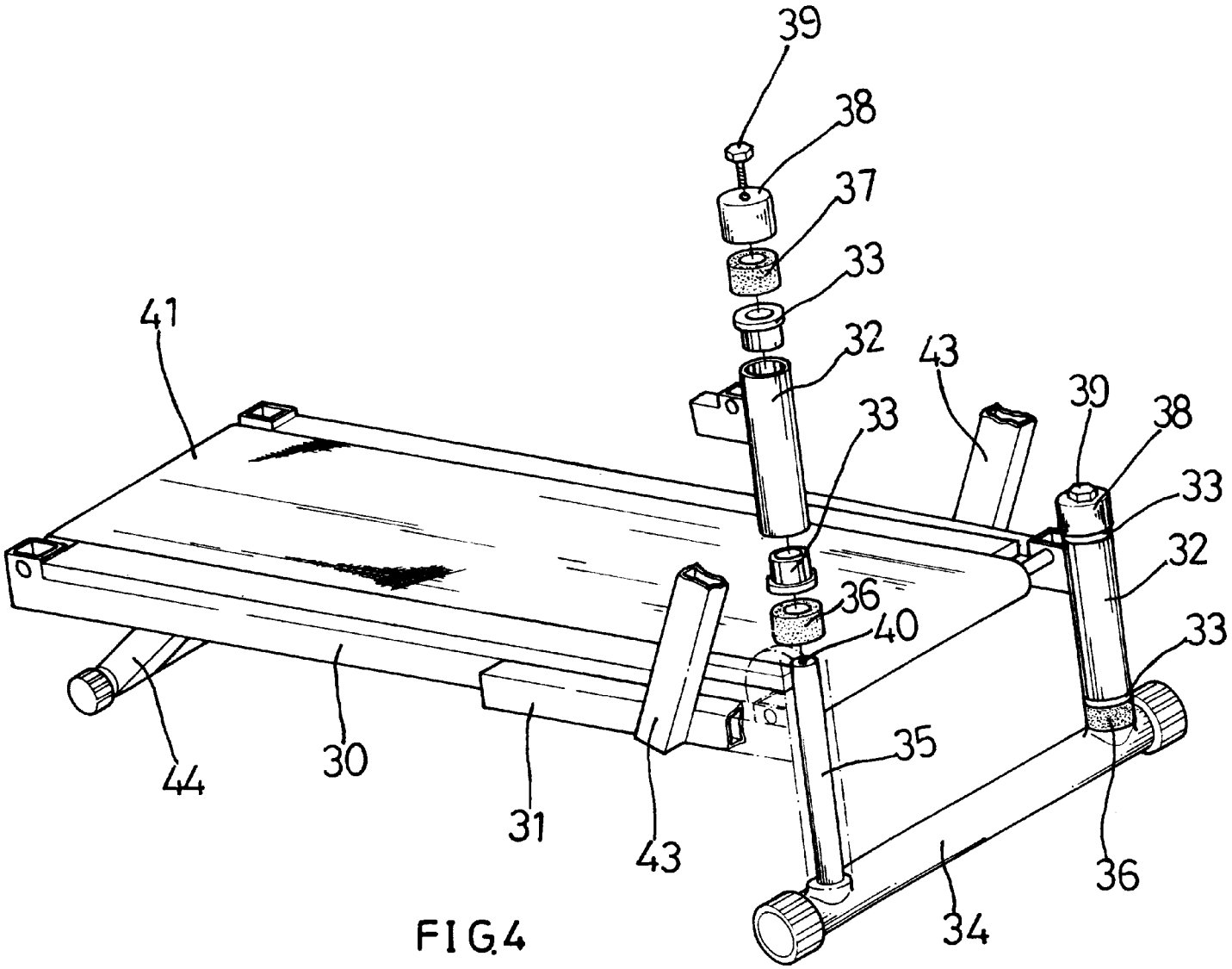
FIG. 4 is an exploded perspective view according to the present invention.

The preferred embodiment of the present invention is shown in FIGS. 4 and 5. The embodiment consists of two connecting rods 31 installed on both sides of the support board 30, two tubes 32 beside the two connecting rods 31 and two insertion units 33 on both ends of the tubes 32. Each tube 32 is connected to an angled support rod 35 which is connected to front transverse rod 34, with an elastic unit 37, a cap 38 and a fixing bolt 39. Therefore, the support board 30 can send its vibrations to the two tubes 32 and the vibrations can be effectively absorbed by the two elastic units 36 and 37 at both sides of the tubes 32.

Moreover, because each tube 32 is well held by two insertion units 33 on both sides, each tube 32 is well held down. In addition, because each tube 32 is not contact with the angled support rod 35 directly, there is no friction and noises generated between them.

Other commonly used treadmills have a running belt 41, support board 42, hand rod 43, rear support rod 44, etc. However, their structure is different from that of the present invention. So, we will not describe them in detail.

Finally, if any one of the two insertion units 33 or two elastic units 36 and 37 needs to be fixed or replaced, just undo the fixing bolt 39 and take out the front transverse rod 34 to make its angled rod 35 separate from the tube 32; it is not necessary to disassemble the running belt 41 or support board 42. Therefore, the present invention can provide sufficient practicality and convenience.

What is claimed is:

1. A vibration absorbing structure for a treadmill comprising: two connecting rods, a support board, said two connecting rods attached on each side of said support board; two tubes, said tubes attached adjacent said connecting rods; two insertion units inserted into said tubes; an angled support rod on which said tube is inserted mounted on a front transverse rod having two ends; first elastic units mounted perpendicular to each of said angled support rods, said first elastic units being located between each of said tubes and said front transverse rod; second elastic units, a first cap, second cap, a first fixing bolt, second fixing bolt; said tubes being held down by said second elastic units, said first cap, said second cap, said first fixing bolt, and said second fixing bolt, respectively; the vibrations from the support board being effectively absorbed by said first and second elastic units on both sides of said tubes.

* * * * *